US005521569A

United States Patent [19]

Blochouse

[11] Patent Number: 5,521,569

[45] Date of Patent: May 28, 1996

[54] HYPER-RAPID CIRCUIT BREAKER

[76] Inventor: Roland Blochouse, Rue Vieille Voie de Liège, 10 B, B-4140 Sprimont, Belgium

[21] Appl. No.: 920,326

[22] PCT Filed: Feb. 18, 1991

[86] PCT No.: PCT/BE91/00013

§ 371 Date: Dec. 15, 1992

§ 102(e) Date: Dec. 15, 1992

[87] PCT Pub. No.: W091/13452

PCT Pub. Date: Sep. 5, 1991

(Under 37 CFR 1.47)

[30] Foreign Application Priority Data

Feb. 23, 1990 [EP] European Pat. Off. ..... 90870030

[51] Int. Cl.[6] ..... H01H 53/00

[52] U.S. Cl. ..... 335/147; 218/43

[58] Field of Search ..... 200/148 R, 148 A, 200/144 B, 144 R, 34, 81 R; 335/147–150; 218/43, 57, 61, 68, 82, 83, 84, 91, 92, 93, 154, 66

[56] References Cited

U.S. PATENT DOCUMENTS 3,655,935 4/1972 Houben ..... 200/166 H
4,041,264 8/1977 Grune ..... 200/148 R
4,209,680 6/1980 Garzon ..... 200/148 R
4,430,535 2/1984 Berg et al. ..... 200/82 R
5,059,932 10/1991 Bonhomme ..... 335/147

*Primary Examiner*—Kristine L. Kincaid
*Assistant Examiner*—Michael A. Friedhofer
*Attorney, Agent, or Firm*—Chilton, Alix & Van Kirk

[57] ABSTRACT

A hyper-rapid circuit breaker is described which is assisted by a semiconductor control circuit, including a repulsion coil, a repulsion disk (37) associated with a contact bridge (39) carrying the movable contacts (41), the repulsion disk (37) collaborating with the repulsion coil (35), a maintaining spring for retaining the contacts in the closed state acting on a tail piece integrally connected to the repulsion disk (37), and a damping assembly which includes a plunger rod (95) integrally connected to the repulsion disk (37), and a reservoir (99) containing fluid intended to absorb the kinetic energy of the repulsion disk (37)/tail piece (43)/plunger rod (95) assembly upon repulsion by the repulsion coil (35), by adaptation of the shapes of the plunger rod (95) and of the reservoir (99) with respect to each other so as to have available fluid-removal sections which can vary as a function of the travel of the plunger rod (95), the travel taking place in two stages, acceleration with a large passage section and braking travel with a progressively reduced passage section.

10 Claims, 3 Drawing Sheets

HYPER-RAPID CIRCUIT BREAKER

SUBJECT OF THE INVENTION

This invention relates to a current-limiter hyper-rapid circuit breaker which can be used at medium-high voltage and is, more particularly, adapted to electrical traction in railroad vehicles or stationary equipment. It concerns, more particularly, the mechanical part of a hyper-rapid circuit breaker which is equipped with an electronic control circuit.

PRIOR ART

It is well known that electrical networks such as those used for traction and in industry are becoming increasingly complex and powerful. The design of the interrupting devices must be developed in order to interrupt increasingly high currents and to reduce maintenance costs. An interrupting device of the new generation must be rapid in order to limit the current and to reduce the mechanical and thermal stresses on the entire installation, as well as the wear of its contacts and of its blowout chamber. Interrupting devices currently comprise rapid or ultra-rapid mechanisms for opening the contacts, and a blowout chamber in which the arc created is confined and cooled. These devices entail significant expense as a result of the maintenance operations and the replacements of worn parts.

Among the problems encountered, it is known that interruption of an electric circuit is likely to give rise to an excessive speed of displacement of elements of the interrupting device. It may be necessary to control the speed of these elements during a short period of time after the interruption. The higher their speed, the more efficient the braking applied to them must be.

The document FR-A-2 438 333 will be mentioned, for example, by way of illustration, which document describes a conventional electric power interrupter equipped with a damper comprising a cylinder filled entirely with oil and in which is displaced a piston connected in an articulated manner to the interrupter. This piston, which is provided with orifices, is braked at places along its travel in the cylinder, irrespective of the direction of its displacement.

Another example is given by the document DE-U-6606297 which describes a damping pump for an electric circuit breaker; a piston provided with orifices which can be sealed by return valves is also displaced in a cylinder containing damping liquid. The structure of this device is designed in order to permit, upon disconnection, the rapid extinction of the intense electric arcs, whilst at the same time also extinguishing, at an appropriate extinction distance, the critical electric arcs of low intensity.

Various associations between mechanisms and semiconductor control circuits have been proposed.

European Patent Application No. 0 184 566 describes an apparatus in which the interruption, without any significant arc, is obtained by joining an oscillating circuit, controlled by semiconductors and the self-induction coil of which is used as a repulsion coil, to a magnetically maintained hyper-rapid mechanism in which a same element serves at the same time as a repulsion disk and as a movable contact bridge. The mechanism is associated with an oscillating circuit via power semiconductors and comprises, in particular:

- a spiral repulsion coil situated in an insulating compound and serving as a self-induction coil for the oscillating circuit,

- a metal disk serving as a contact bridge and collaborating with the repulsion coil;
- an alternating-movement movable unit;
- a permanent magnet or a hold-on winding, and a magnetic yoke, which elements are inserted into this movable unit;
- an armature collaborating with the magnetic yoke and connected to the disk.

In the case of the apparatus which is described there, a repulsion force is obtained which very quickly assumes considerable proportions. The displacement of the repulsion disk is halted on dampers described as being a layer of deformable material.

European Patent Application no. 0 348 584 proposes a hyper-rapid circuit breaker assisted by a semiconductor control circuit, comprising a repulsion coil, a repulsion disk associated with a contact bridge carrying the movable contacts, said repulsion disk collaborating with said repulsion coil, and a means for maintaining the contacts in the closed state, in which hyper-rapid circuit breaker the maintaining means consists of a maintaining spring acting on the repulsion disk associated with the contact bridge via a retention means acting on an integral tail piece of said repulsion disk, which retention means exerts a pressure sufficient to resist an imposed contact pressure and which is arranged so as to be able to be retracted when the disk is repelled under the effect of the repulsion coil. The damping or braking means is not described in detail here but a conventional damper has been shown in the figures.

With a view to being able to obtain substantial accelerations so as to separate the contacts of the circuit breaker as rapidly as possible, it is provided for the damping or braking means not to act on the movable part during a first part of the travel. This is why the movable part of the damping means has been dissociated by providing for the movable part to travel freely before it is slowed down. As a result, when the movable part, moving very quickly, encounters the damping or braking means, a violent impact occurs which generates various forms of damage, all the more so since accelerations of the order of 30,000 g and speeds of the order of 30 m/s are present.

Furthermore, the conventional damping means employ a fluid which is forced to pass through one or more orifices in order to create head losses as a result of increasing speed. In the light of the considerable accelerations and speeds of the movable part to be braked, the speeds of the fluid are so high that the fluid jets are capable of destroying the elements such as the seals or guide nozzles. Such a problem is liable to occur in a damping pump such as that described in the abovementioned document DE-U-6 660 297.

Moreover, after a maneuver of interrupting an electric circuit, the movable part of the circuit breaker and the movable part of the damping means are in an end-of-travel position and the circuit breaker must be rearmed, and the electric circuit therefore closed again. In the case of the damping means described, the displacement of the active part of the damping means is generally slower than that of the movable part of the circuit breaker, the latter having to be rapid so as to prevent the formation of pre-arcs. As a result, if the circuit breaker is triggered again before the active part of the damping means has returned to its starting position, the movable part of the circuit breaker is no longer braked and crashes against the active part of the damping means.

Attempts have been made to overcome this difficulty by interconnecting the movable parts with a play corresponding to the free travel, or by making use of a return spring on the damping means. However, these solutions sustain impacts very poorly and require frequent maintenance operations and/or replacements.

OBJECT OF THE INVENTION

The object of the present invention is to provide a hyper-rapid circuit breaker which does not have the abovementioned disadvantages, more particularly a hyper-rapid circuit breaker of the abovementioned type equipped with a damping means which permits a considerable acceleration at the beginning of the travel of the movable part of the circuit breaker and a gradual braking, without any rebound and without making use of a mechanical stop, on the end of the travel. The damping means must be provided so as to permit an acceleration of the order of 30,000 g or more providing a speed of up to 40 m/s over a very reduced distance of the order of 2 to 3 mm, and then to brake the movable part gradually until it is halted over a travel of 30 to 40 mm, limiting stresses. It must have a simple, robust and inexpensive structure and not require frequent maintenance operations.

ESSENTIAL ELEMENTS OF THE INVENTION

According to the present invention, the hyper-rapid circuit breaker assisted by a semiconductor control circuit comprises a repulsion coil, a repulsion disk associated with a contact bridge carrying the movable contacts, said repulsion disk collaborating with said repulsion coil, a means for retaining the contacts in the closed state which exerts a pressure sufficient to resist an imposed contact pressure and which is arranged in a liberal [sic] manner when the disk is repelled under the effect of the repulsion coil, and a damping means, said damping means comprising a plunger rod integral with the repulsion disk, and a reservoir containing fluid intended to absorb the kinetic energy of the repulsion disk/plunger rod assembly upon repulsion by the repulsion coil, by adaptation of the shapes of the plunger rod and of the reservoir with respect to each other so as to have available fluid-removal sections or passages which can vary as a function of the travel of the plunger rod.

The present invention thus provides an above-described hyper-rapid circuit breaker equipped with a simple damping means, which permits the movement of the movable part of said circuit breaker to be braked without any impact against a movable or fixed mechanical stop, over a reduced travel, whilst at the same time permitting a rapid opening of the contacts at the beginning of the travel. Indeed, if the shapes of the reservoir and of the plunger rod are adapted in such a way that, at the beginning of the travel, the removal section is relatively great and that, as the plunger rod penetrates more deeply into the fluid reservoir, said section narrows, the braking is gradual whilst at the same time permitting a substantial acceleration at the beginning of the travel. Moreover, given that the plunger rod is integrally connected to the repulsion disk, the apparatus is not subject to the disadvantages caused by the impacts of the movable part of the circuit breaker on an active part of the damping means.

The repulsion disk/plunger rod assembly is preferably all in one piece. There is no mechanical play possible between these elements which are displaced at the same speed after the repulsion. This embodiment is particularly suited to a hyper-rapid circuit breaker in which the very high accelerations and speeds which are reached would cause rapid degradation of elements interconnected by mechanical means with one or more degrees of freedom. The repulsion disk/plunger rod assembly can consist of a single piece or of a plurality of pieces integrally connected, for example by welding or by fitting together. These pieces can, in particular, be screwed with a prestress such that there is no possibility of any play appearing between them during the accelerations or decelerations linked to the operation of the hyper-rapid circuit breaker.

It will also be noted that the device of the invention requires no special mechanism such as regulating nozzles, or movable mechanisms such as flaps etc which are in general sensitive to malfunctions, and which [sic] does not make use of a spring, the disadvantages of which have been described above. The movement of a fluid which is not subject to either wear or rupture is used for the braking. In the case of rearming the circuit breaker, the damping means is immediately ready to be used once again even if the travel has been incomplete.

Another advantage lies in the fact that the device of the invention is self-centering.

For reasons of simplification of manufacture, the reservoir advantageously has a substantially cylindrical shape and the plunger rod has a profiled end widening out from the end.

It has been noted that a tapered profiled shape consisting of a succession of frustums having different angles of taper, or of a continuous curve making it possible to obtain a braking force which is as constant as possible [lacuna]. The braking property can be adjusted by adapting this taper or curve. It is also possible to provide a substantially cylindrical or rectangular plunger rod associated with a reservoir, the inner face of which is tapered or profiled and, for example, consists of a continuous succession of frustums of different taper with respect to one another, or of a continuous curve making it possible to obtain a braking force which is as constant as possible.

As already mentioned in the European Patent Application no. 0 348 584, the movable part of the hyper-rapid circuit breaker consists of a relatively light material so as to reduce the inertia. In a similar manner, the plunger rod can also consist of a light material, in particular a high-strength aluminum alloy. The increase in the mass of the movable part is thus relatively small relative to the circuit breaker described in the European Patent Application no. 0 184 566 or 0 348 584 (mentioned above).

It should also be noted that the braking travel is independent of the maximum speed reached by the movable part of the circuit breaker according to the invention.

BRIEF DESCRIPTION OF THE FIGURES

The invention is described in more detail below with reference to the drawings, in which.

DETAILED DESCRIPTION OF A PREFERRED EMBODIMENT

Figure 1:
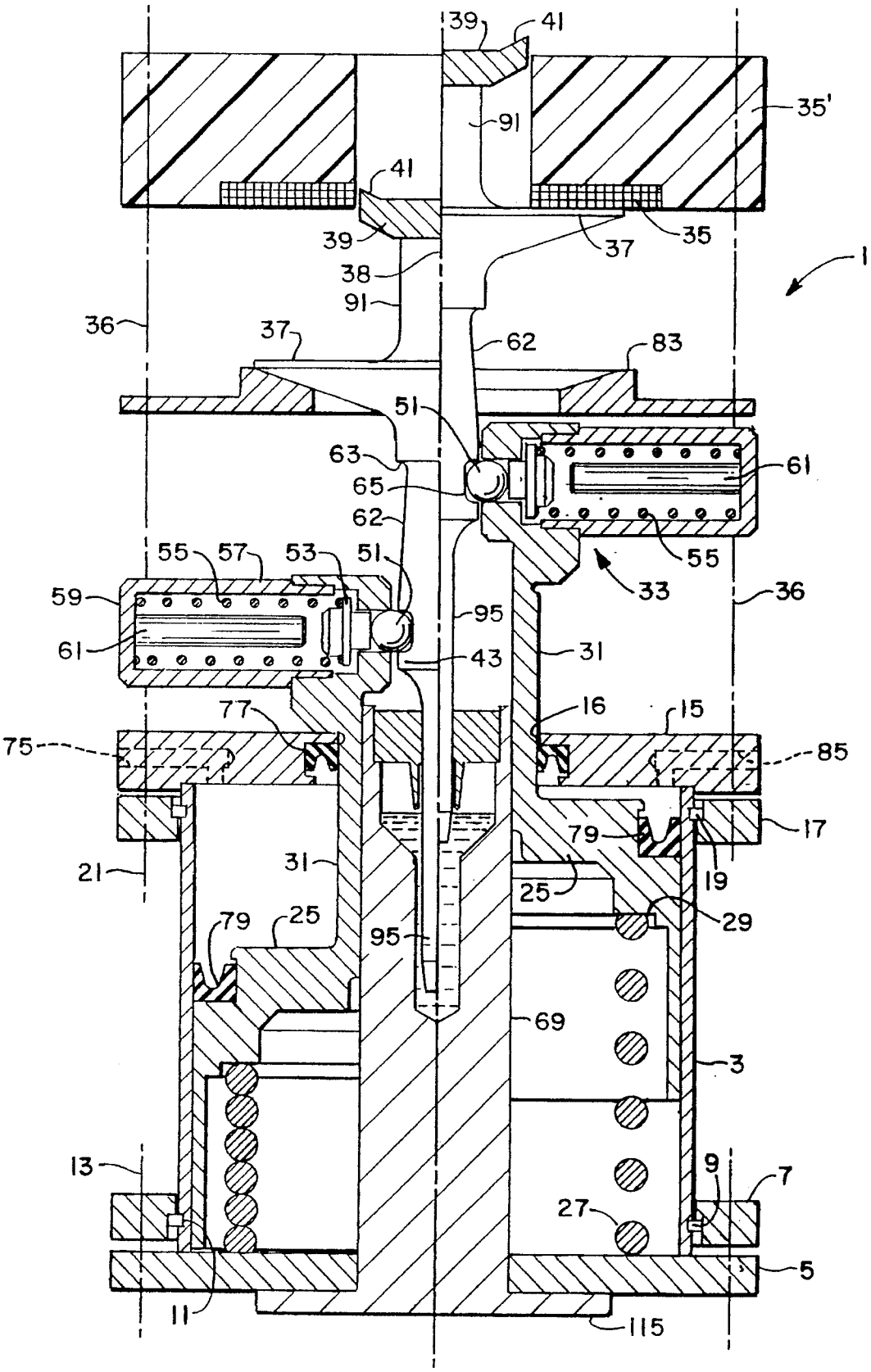
FIG. 1 is an overall sectional view of a circuit breaker according to the invention.

In the figures, identical reference numerals represent identical or similar elements. The circuit breaker 1 according to the present invention comprises a cylinder 3 sealed at one end by a bottom cover 5 which is fixed thereto by a flange 7 and a ring 9 housed in a corresponding groove 11 of said cylinder, the cover being clamped by means of screws or bolts 13, and sealed at the other end by a second cover 15 which is fixed thereto in a similar manner by a flange 17, a ring 19 and screws or bolts 21.

Said cylinder 3 comprises, inside, a piston 25 which can slide therein, and a pressure spring 27 which bears on the bottom cover 5 and on a shoulder 29 made in said piston. Said piston is surmounted by a sleeve 31 which traverses the cover 15 in its corresponding central opening 16. Said sleeve 31 is surmounted, at its free end, by the retention means which carries the general reference numeral 33.

The circuit breaker according to the present invention is surmounted by a repulsion coil 35 which is advantageously molded with a resin 35', the whole being assembled with bolts or threaded rods 36.

It furthermore comprises a repulsion disk 37 associated with a contact bridge 39 carrying the movable contacts 41, and with a tail piece 43 and plunger rod 95, which elements will be described in more detail below.

The retention means 33 mounted on the end of the sleeve 31 by screwing, for example, comprises a plurality of balls or rollers 51 which are applied against the tail piece 43 of the repulsion disk 37 with an adjustable pressure. Indeed, a pusher 53 actuated by a spring 55 accommodated in a preferably cylindrical guide 57, sealed by a cover 59 and provided with a stop 61 preventing the pusher from being depressed excessively, applies pressure to a ball or roller 51.

The tail piece 43 is made integral with the repulsion disk 37. The tail piece 43 preferably comprises 4 inclined planes 62 which move away from the axis 38 the further they get from the repulsion disk 37, and is provided, at the end near the repulsion disk 37, with a shoulder 63 and, at the free end, with a groove 65. The circuit breaker furthermore comprises a damping means described in more detail below.

In the rest state, the spring 27, which is preferably pre-compressed, maintains the piston 25, and consequently the sleeve 31, in the upper position, the repulsion disk being situated in the lower position, spaced apart from the repulsion coil.

In order to arm the circuit breaker according to the present invention (left-hand part of FIG. 1), pressurized air must be introduced through the duct or ducts 75 made in the cover 15. The chamber defined by the wall of the cylinder 3, the cover 15 and the piston 25 is filled with compressed air and, under the pressure thus exerted, the maintaining spring 27 is compressed and the piston 25 is lowered, carrying with it the sleeve 31 and the retention means 33. A seal 77 maintains the sealing contact between the sleeve 31 and the cover 15. Another seal 79 is intended to maintain sealing contact between the piston 25 and the cylinder 3.

In order to prevent the retention means 33 from carrying with it the repulsion disk 37, owing to the pressure of the balls or rollers 51 on a surface 61 inclined with respect to the axis 38, said disk 37 is retained by fixed stops 83.

It should be noted that the cylindrical wall of the piston 25 also performs the role of a mechanical stop for the spring 27, preventing the latter from being compressed with its turns adjoining. The cylindrical wall is furthermore dimensioned in such a way that, when the spring 27 is compressed to the maximum, the balls or rollers 51 engage in the grooves 65.

In order to close the circuit breaker 1 according to the present invention under optimum conditions, in other words relatively rapidly, it should be ensured that the maintaining spring 27 can release the stored energy rapidly. In order to do this, the compressed air can be connected to the atmosphere by outlet ducts 85 which may be equipped with quick-release valves. In this case, the formation of pre-arcs is limited.

The sleeve 31 integral with said piston 25 carries with it, via the retention means, and more particularly the balls or rollers 51, the tail piece 43, the plunger rod 95 and, therefore, the repulsion disk 37 until the contact bridge carrying the movable contacts comes into contact with the fixed contacts (right-hand part of FIG. 1).

The force of the springs 55 must therefore be sufficient to maintain the balls or rollers 51 in the grooves 65 during this stage, and to ensure an optimum contact pressure.

Let us assume now that the current increases to unacceptable levels in the electric circuit in which the circuit breaker according to the present invention is inserted. In this case, the electronic control circuit sends an ogival current pulse to the repulsion coil 35 and, by an electrodynamic effect, to the currents induced in the disk 37. As a result, a particularly high repulsion force is established. This high force makes it possible to dislodge the balls or rollers 51 from the grooves 65 by the springs 55 being compressed, thus releasing the movable pulley [sic]. The repulsion disk associated with the contact bridge 39 and with the tail piece 43 integral with the plunger rod 95, subjected to the repulsion force, is subject to a particularly high acceleration; this reduces the risk of the formation of an arc and of wear on the contacts or [sic] rapidly creating a sufficient distance between the fixed and movable contacts.

The repulsion disk accelerated in this way between 20,000 and 40,000 g at speeds lying between 10 and 50 m/s over 1 to 5 mm must subsequently be braked over a travel of 20 to 40 mm. The braking role is performed by the damper assembly and by the balls or rollers 51 which also enable the disk 37 to be immobilized toward the bottom.

Figure 2:
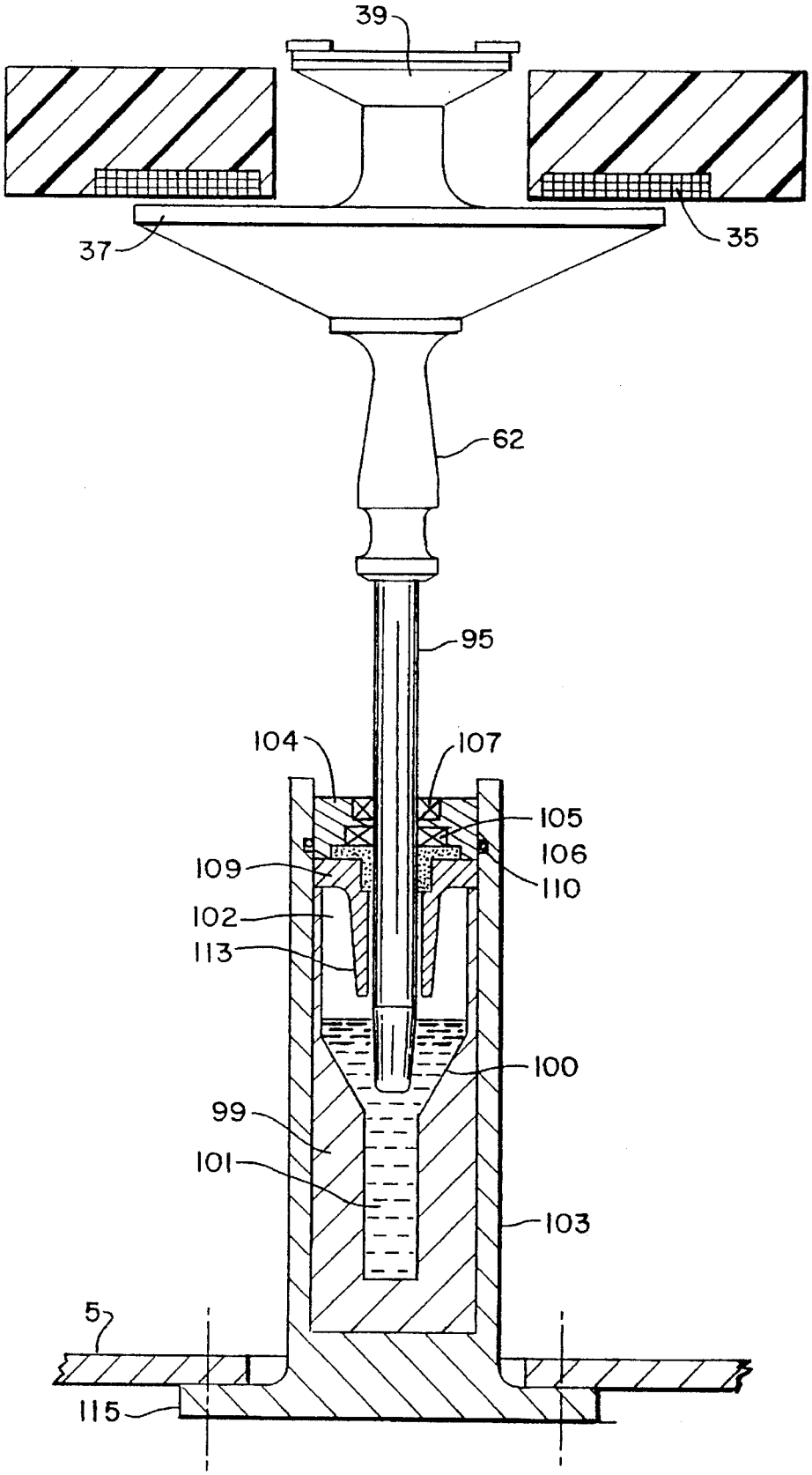
FIG. 2 is a diagrammatic detailed view of the movable part of a hyper-rapid circuit breaker, the members for arming the circuit breaker and the casing of the latter being omitted for reasons of clarity.

With reference to FIG. 2, the damping assembly essentially comprises the plunger rod 95 integral with the repulsion disk 37, and a fluid reservoir 99. The shapes or profiles of the rod 95 and of the reservoir 99 are adapted in such a way that the section of the rod which penetrates into the reservoir 99 causes a variation, i.e., a reduction in the annular fluid-removal section or passage lying between said rod and said reservoir during its displacement. According to the embodiment shown, the reservoir 99 has a substantially cylindrical or rectangular shape, comprising a conical profiled zone, whilst the end of the rod 95 is tapered inwardly such that it essentially consists of a continuous succession of frustums having a different angle of taper from one another. As a result, the annular leakage section or passage through which the fluid 101 contained in said reservoir 99 is expelled is gradually reduced during the repulsion, maintaining a considerable braking force in spite of the reduction in speed of the moving parts.

The fluid reservoir 99 is advantageously accommodated in a sleeve 103 closed by a cover 104, which is equipped, on the side opposite said reservoir, with sealing means, in particular three seals, a seal 105, a fixed seal 106 and a scraping seal 107. The seals are advantageously retained in their seating by means known per se such as elastic rings or screwed and glued assemblies.

The plunger rod 95 is advantageously guided in a guide ring 109 with a self-lubricating lining 110. This ring is advantageously arranged between the reservoir 99 and the seals 105 and 107.

Said guide ring 109 is advantageously equipped with a protective skirt 113 which prevents the jets of fluid from damaging the self-lubricating ring 110 and/or the seals 105 and 107.

A volume of air 102 is provided above the upper level of the fluid 101. Given that the reservoir 99 is closed by the ring 109, the total volume occupied by the fluid 101 and the air 102 is constant. The penetration of the plunger rod 95 into the fluid 101 during the repulsion induces a corresponding rise in the level of the fluid 101 inside the reservoir 99, since the fluid flows through the annular passage formed by the rod and the wall of the reservoir toward the space occupied by the air 102 this rise being compensated by the compression of the volume of air 102.

The reservoir 99 consists, in the embodiment shown, of a single piece. An advantageous alternative consists in manufacturing the reservoir in two parts, the parts serving for the braking of the plunger rod 95 being surmounted by a spacer ring.

According to a preferred embodiment, the plunger rod consists of a high-strength light alloy surface-finished at least on the part coming into contact with the self-lubricating ring and the seals 105 and 107. In the case of the example, an aluminum alloy has been used which has been treated by hard anodizing.

The plunger rod 95 can be formed integrally with the repulsion disk 37 and/or with the tail piece 43. It is also possible, however, to provide an assembly, in particular a screwed and glued assembly.

The sleeve 103 in which the various elements are accommodated is advantageously introduced from beneath into the hyper-rapid circuit breaker and fixed by a flange 115 to the outer surface of the bottom cover 5.

It has also been noted that, as a result of the shape of the parts, the sleeve comprising, in particular, the reservoir filled with fluid can, if necessary, be introduced horizontally into the circuit breaker without the fluid being able to escape (ease of assembly, for example).

Figure 3:
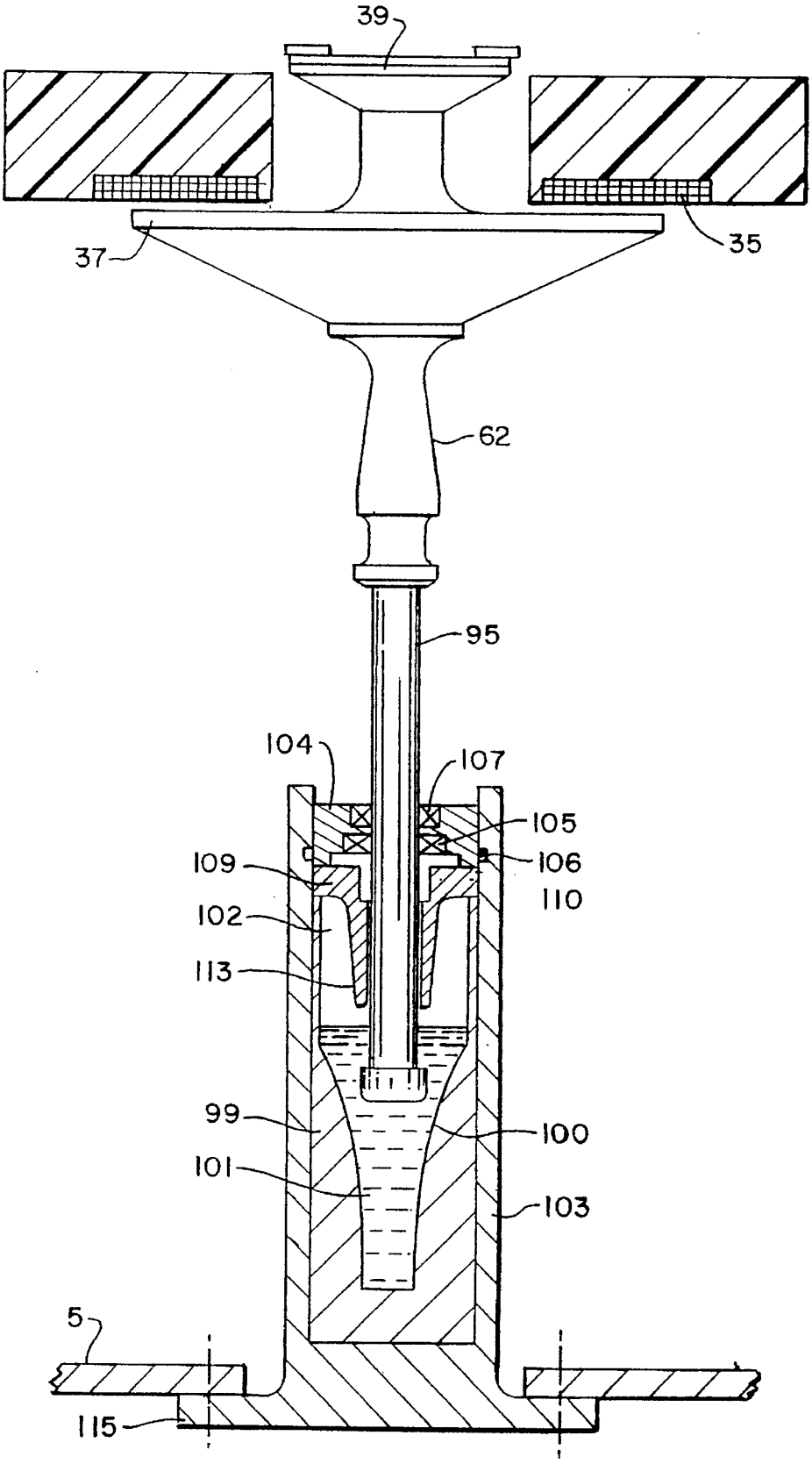
FIG. 3 is a diagrammatic view of an alternative embodiment.

With reference to FIG. 3, another embodiment has been shown in which the plunger rod 95 integral with the repulsion disk 37 has an essentially cylindrical or rectangular shape and is associated with a fluid reservoir 99, the inner face of which is tapered or profiled in a curve constructed in such a way that the fluid in said reservoir is squeezed upwards through the passage formed by the rod and reservoir.

I claim:

1. Hyper-rapid circuit breaker assisted by a semiconductor control circuit, comprising a repulsion coil (35), contacts (41) movable between an open position and a closed position, a contact bridge (39) supporting said contacts, a repulsion disk (37) connected to said contact bridge and being operatively associated with said repulsion coil (35), means for retaining the contacts in the closed position while permitting movement of the contacts toward the open position when the disk (37) is repelled under the effect of the repulsion coil (35), and damping means for damping the repelled disk, characterized in that said damping means comprises a plunger rod (95) integral with the repulsion disk (37) to form a repulsion disk/plunger rod assembly movable as a unit, and a reservoir (99) for receiving the plunger rod, said reservoir containing fluid intended to absorb the kinetic energy of the repulsion disk/plunger rod assembly as the rod is driven into the reservoir upon repulsion of the assembly by the repulsion coil (35), the plunger rod (95) and the reservoir (99) forming therebetween a fluid passage for displacement flow of the energy absorbing fluid within the reservoir, said rod and reservoir being contoured so as to reduce the size of said fluid passage as a function of the travel of the plunger rod during movement of the contacts toward the open position.

2. Hyper-rapid circuit breaker according to claim 1, characterized in that the reservoir (99) has a substantially cylindrical or rectangular shape and the plunger rod (95) has a tapered profiled free end that is driven into the reservoir.

3. Hyper-rapid circuit breaker according to claim 1, characterized in that the plunger rod (95) has a tapered profiled end consisting of a continuous succession of frustrums having different angles of taper making it possible to obtain an essentially constant braking force.

4. Hyper-rapid circuit breaker according to claim 1, characterized in that the reservoir comprises a conical zone (100).

5. Hyper-rapid circuit breaker according to claim 1, characterized in that the plunger rod (95) has a substantially cylindrical or rectangular shape and the fluid reservoir (99) has an inner face which is profiled in such a way that the fluid in said reservoir is squeezed through the passage as the plunger rod is repulsed.

6. Hyper-rapid circuit breaker according to claim 1, characterized in the reservoir is profiled on a continuous curve making it possible to obtain an essentially constant braking force.

7. Hyper-rapid circuit breaker according to claim 1, characterized in that the repulsion disk (37) and the plunger rod (95) consist of a light material.

8. Hyper-rapid circuit breaker according to claim 1, characterized in that the fluid reservoir (99) is accommodated in a sleeve (103) equipped with sealing means for preventing fluid loss from the reservoir.

9. Hyper-rapid circuit breaker according to claim 8, characterized in that the reservoir includes a self-lubricating guide ring (109, 110) for guiding the plunger rod, said guide ring being equipped with a protective skirt (113).

10. Hyper-rapid circuit breaker according to claim 9, characterized in that the plunger rod (95) is surface-finished at least on the part coming into contact with the guide ring (109, 110).

* * * * *